US011427924B1

(12) United States Patent
Hou et al.

(10) Patent No.: US 11,427,924 B1
(45) Date of Patent: Aug. 30, 2022

(54) APPARATUS FOR ELECTRO-CHEMICAL PLATING

(71) Applicant: TAIWAN SEMICONDUCTOR MANUFACTURING CO., LTD., Hsinchu (TW)

(72) Inventors: Kuo-Lung Hou, Taichung (TW); Ming-Hsien Lin, Taichung (TW); Tsung-Cheng Wu, Taichung (TW)

(73) Assignee: TAIWAN SEMICONDUCTOR MANUFACTURING CO., LTD., Hsinchu (TW)

( * ) Notice: Subject to any disclaimer, the term of this patent is extended or adjusted under 35 U.S.C. 154(b) by 0 days.

(21) Appl. No.: 17/232,161

(22) Filed: Apr. 16, 2021

(51) Int. Cl.

| | |
|---|---|
| ***C25D 21/12*** | (2006.01) |
| ***C25D 7/12*** | (2006.01) |
| ***C25D 5/54*** | (2006.01) |
| ***C25D 21/00*** | (2006.01) |
| ***C25D 17/00*** | (2006.01) |

(52) U.S. Cl.
CPC ..... *C25D 21/12* (2013.01); *C25D 5/54* (2013.01); *C25D 7/12* (2013.01); *C25D 17/001* (2013.01); *C25D 21/00* (2013.01)

(58) Field of Classification Search
CPC ..... C25D 17/001; C25D 21/12; C25D 21/14; C25D 17/02; C25D 21/16; C25D 21/18
See application file for complete search history.

(56) References Cited

U.S. PATENT DOCUMENTS

| | | | | |
|---|---|---|---|---|
| 6,126,798 | A | 10/2000 | Reid et al. | |
| 7,179,359 | B2 * | 2/2007 | Ishida | C25D 5/08 257/E21.175 |
| 2006/0032758 | A1 * | 2/2006 | Klocke | C25D 7/123 205/220 |
| 2007/0246350 | A1 * | 10/2007 | Togashi | C25D 17/001 204/237 |
| 2011/0315547 | A1 * | 12/2011 | Suemoto | C25D 17/001 204/275.1 |
| 2016/0222537 | A1 | 8/2016 | Shen et al. | |
| 2018/0202062 | A1 * | 7/2018 | Dinneen | C25D 5/08 |

* cited by examiner

*Primary Examiner* — Brian W Cohen
(74) *Attorney, Agent, or Firm* — McDermott Will & Emery LLP

(57) ABSTRACT

An electrochemical plating apparatus for depositing a conductive material on a wafer includes a cell chamber. The plating solution is provided from a bottom of the cell chamber into the cell chamber. A plurality of openings passes through a sidewall of the cell chamber. A flow regulator is arranged with each of the plurality of openings configured to regulate an overflow amount of the plating solution flowing out through the each of the plurality of openings. The electrochemical plating apparatus further comprises a controller to control the flow regulator such that overflow amounts of the plating solution flowing out through the plurality of openings are substantially equal to each other.

20 Claims, 17 Drawing Sheets

APPARATUS FOR ELECTRO-CHEMICAL PLATING

BACKGROUND

Electrochemical plating (ECP) is a common manufacturing process that applies a thin layer of one metal onto another. Electrochemical plating is widely performed in the electronics industry to deposit electrically conductive metals used in printed circuit boards, connectors, and semiconductor interconnects.

Electroplating cells (e.g., vessels) are used in the ECP processes to provide a plating solution where metal electrolytes deposit onto the wafer. In wafer electroplating processing, the quality and uniformity of the deposited metal layer on the wafer is a major concern. In the ECP processes, a uniform, defect-free metal film is desired, because defects on the deposited metal film such as pits, protrusions, or particles reduce wafer performance and frequently yield.

BRIEF DESCRIPTION OF THE DRAWINGS

The present disclosure is best understood from the following detailed description when read with the accompanying figures. It is emphasized that, in accordance with the standard practice in the industry, various features are not drawn to scale and are used for illustration purposes only. In fact, the dimensions of the various features may be arbitrarily increased or reduced for clarity of discussion.

DETAILED DESCRIPTION

It is to be understood that the following disclosure provides many different embodiments, or examples, for implementing different features of the disclosure. Specific embodiments or examples of components and arrangements are described below to simplify the present disclosure. These are, of course, merely examples and are not intended to be limiting. For example, dimensions of elements are not limited to the disclosed range or values, but may depend upon process conditions and/or desired properties of the device. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Various features may be arbitrarily drawn in different scales for simplicity and clarity.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The device may be otherwise oriented (rotated 90 degrees or at other orientations) and the spatially relative descriptors used herein may likewise be interpreted accordingly. In addition, the term "made of" may mean either "comprising" or "consisting of."

The manufacture of semiconductor devices often requires the formation of electrical conductors on semiconductor wafers. For example, electrically conductive leads on the wafer are often formed by electrochemical plating (depositing) an electrically conductive material such as copper on the wafer and into patterned trenches. Electrochemical plating involves making electrical contact with the wafer surface upon which the electrically conductive layer is to be deposited. A current is then passed through a plating solution (i.e. a solution containing ions of the element being deposited, for example a solution containing Cu') between an anode and the wafer plating surface, with the wafer plating surface act as a cathode. This causes an electrochemical reaction on the wafer plating surface resulting in the deposition of the electrically conductive layer.

There is a need for an improved process that allows the wafer contacting the plating solution at a plating surface in a horizontally parallel manner to maintain a uniform thickness/density of the electrochemical plating so that defect-free plating occurs. Achieving a uniform deposition quality without any bubbles and/or by-products from the processing solution during the electrochemical plating is desirable.

Figure 1:
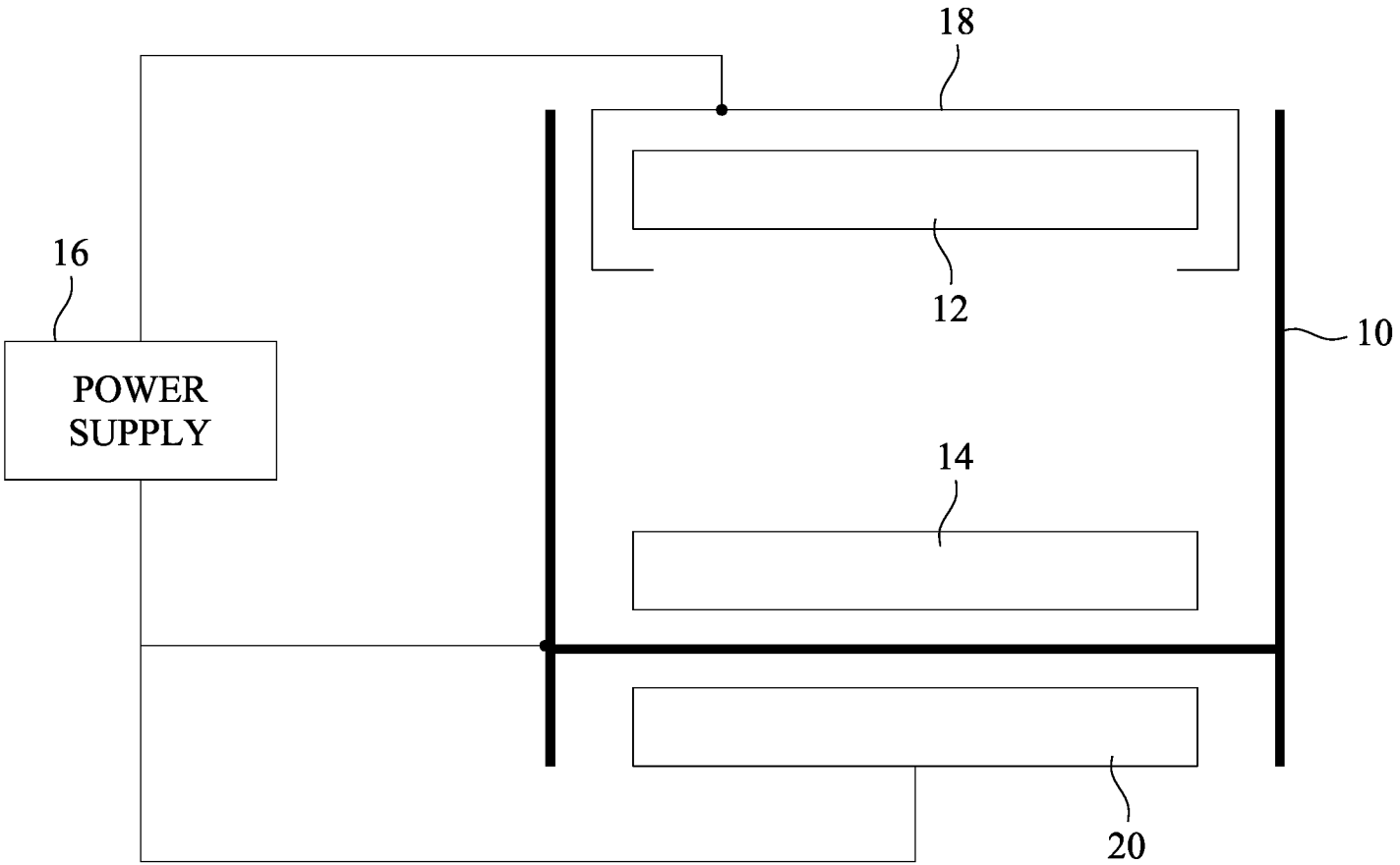
FIG. 1 is a schematic view of an electrochemical plating system.

FIG. 1 is a schematic view of an electrochemical plating system. The electrochemical plating system includes a process vessel or tank 10 that holds a suitable plating bath. The wafer 12 acts as a cathode onto which material is deposited derived from an anode 14 (e.g., Cu), which is disposed within the process vessel or tank 10. In some cases, a third electrode 20 is disposed beneath the vessel 10 but in proximity to the plating bath. A power supply 16 is coupled in an open circuit with electrode 20 and a fixture 18 so as to apply a static electric charge to the wafer 12. In some cases, the fixture 18 is configured to hold and rotate the wafer 12.

Figure 2A:
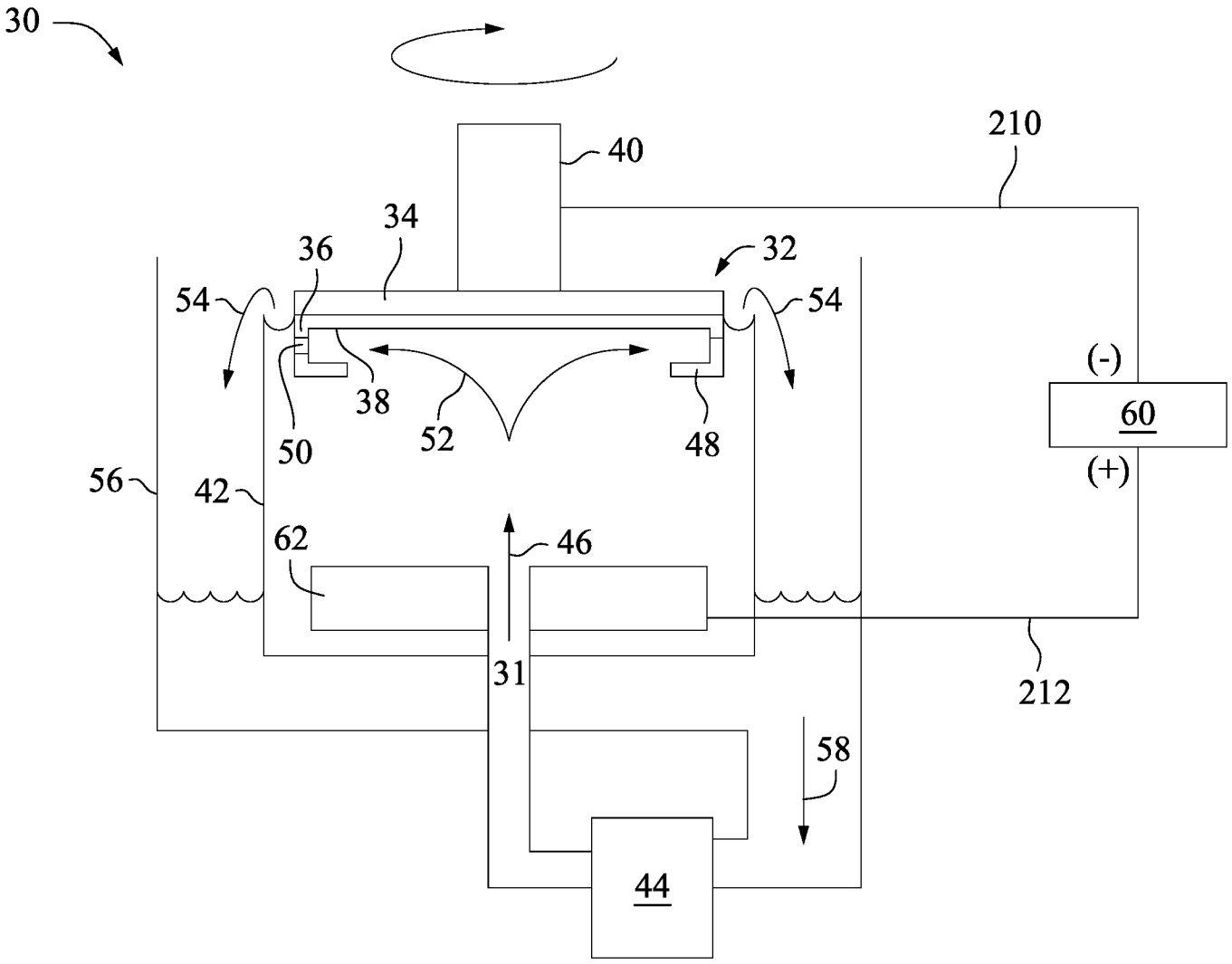
FIG. 2A is a schematic view of an electrochemical plating apparatus including a substrate according to some embodiments of the disclosure.

FIG. 2A is a schematic view of an electrochemical plating apparatus 30 including a substrate 38 according to some embodiments of the disclosure. The electrochemical plating apparatus 30 includes a substrate holder 32 mounted on a rotatable spindle 40 which allows rotation of the substrate holder 32. The substrate holder 32 includes a cone 34, a cup 36 and a flange 48, and apertures 50. Before the electrochemical plating process starts, the substrate 38 is mounted in the cup 36. The substrate holder 32 and the substrate 38 are then placed into an electroplating cell 42 that serves as a container/vessel for containing a plating solution 31, e.g., a copper sulfate ($CuSO_4$) solution. As indicated by arrow 46, the plating solution 31 is continually provided to the electroplating cell 42 by a pump 44. The plating solution 31 flows upwards towards the substrate 38, then radially outward and across the substrate 38, and then flows through the apertures 50 as indicated by arrows 52. By directing the plating solution 31 towards the substrate 38 (e.g., towards the center of the substrate 38), any gas bubbles entrapped on the substrate 38 are removed through the apertures 50. In some embodiments, the plating solution 31 overflows from the electroplating cell 42 to an overflow reservoir 56 as indicated by arrows 54. The plating solution 31 is then filtered and returned to pump 44 as indicated by arrow 58 completing a recirculation of the plating solution 31.

The plating solution 31 may include a mixture of copper salt, acid, water and various organic and inorganic additives that improve the properties of the deposited copper. Suitable copper salts for the plating solution 31 include copper sulfate, copper cyanide, copper sulfamate, copper chloride, copper formate, copper fluoride, copper nitrate, copper oxide, copper fluorine-borate, copper trifluoroacetate, copper pyrophosphate and copper methane sulfonate, or hydrates of any of the foregoing compounds. The concentration of the copper salt used in the plating solution will vary depending on the particular copper salt used.

Various acids can be used in the plating solution 31, including: sulfuric acid, methanesulfonic acid, fluoroboric acid, hydrochloric acid, hydroiodic acid, nitric acid, phosphoric acid and other suitable acids. The concentration of the acid used will vary depending on the particular acid used in the plating solution 31.

Additives for the copper plating solution include brighteners, suppressors and levelers. Brighteners are organic molecules that improve the specularity (or reflectivity) of the copper deposit by reducing both surface roughness and grain-size variation. Suitable brighteners include, for example, organic sulfide compounds, such as bis-(sodium sulfopropyl)-disulfide, 3-mercapto-1-propanesulfonic acid sodium salt, N-dimethyl-dithiocarbamyl propylsulfonic acid sodium salt and 3-S-isothiuronium propyl sulfonate, or mixtures of any of the foregoing compounds. Suppressors are macromolecule deposition inhibitors that adsorb over the surface of the substrate and reduce local deposition rates, thereby increasing the deposition uniformity. Levelers include ingredients with nitrogen functional groups and may be added to the plating solution at a relatively low concentration. Leveling involves the diffusion or migration of strongly current suppressing species to corners or edges of macroscopic objects which otherwise plate more rapidly than desired due to electric field and solution mass transfer effects. The levelers may be selected from the following agents: a polyether surfactant, a non-ionic surfactant, a cationic surfactant, an anionic surfactant, a block copolymer surfactant, a polyethylene glycol surfactant, polyacrylic acid, a polyamine, aminocarboxylic acid, hydrocarboxylic acid, citric acid, entprol, edetic acid, tartaric acid, a quaternized polyamine, a polyacrylamide, a cross-linked polyamide, a phenazine azo-dye, an alkoxylated amine surfactant, polymer pyridine derivatives, polyethyleneimine, polyethyleneimine ethanol, a polymer of imidazoline and epichlorohydrine, and benzylated polyamine polymer.

The substrate 38 and an anode 62 are both immersed in the plating solution 31 (e.g., $CuSO_4$ solution) containing one or more dissolved metal salts as well as other ions that permit the flow of electricity. The substrate 38 acts as a cathode onto which material from the anode 62 is deposited. A DC power supply 60 has a negative output lead 210 electrically connected to the substrate 38 through one or more slip rings, brushes and contacts (not shown). The positive output lead 212 of the power supply 60 is electrically connected to the anode 62. During use, the power supply 60 biases the substrate 38 to have a negative potential relative to the anode 62 causing an electrical current to flow from the anode 62 to the substrate 38. (As used herein, electrical current flows in the same direction as the net positive ion flux and opposite the net electron flux.) This causes an electrochemical reaction (e.g. $Cu^{2+}+2e^{-}=Cu$) on the substrate 38 which results in the deposition of the electrically conductive layer (e.g. copper) on the substrate 38. The ion concentration of the plating solution is replenished during the plating cycle by dissolving the anode 62 which is made of a metallic compound (e.g. $Cu=Cu^{2+}+2e^{-}$).

Figure 2B:
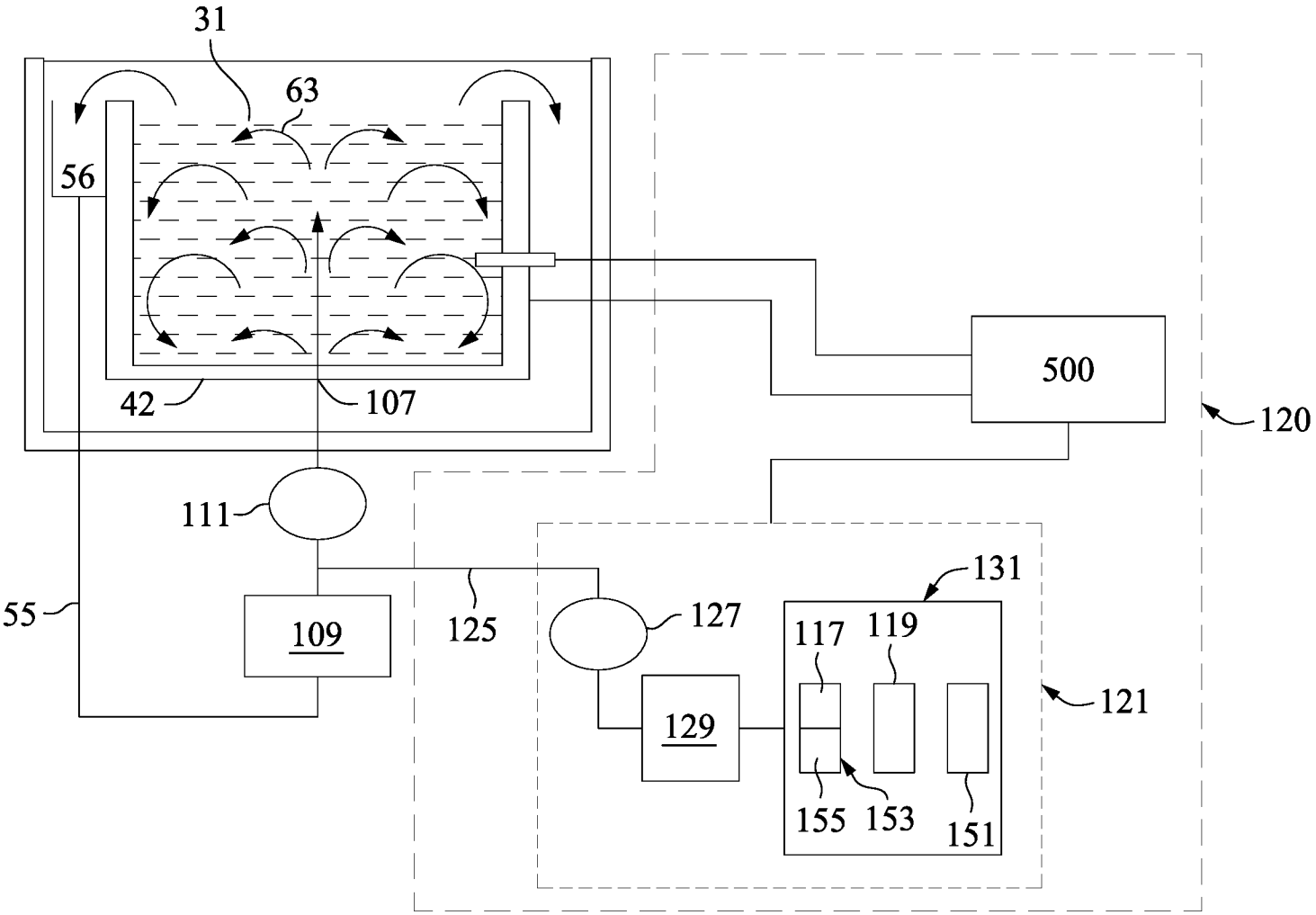
FIG. 2B is a schematic view of a processing system including the electrochemical plating apparatus of FIG. 2A.

FIG. 2B is a schematic view of a processing system 400 that is used with the electrochemical plating apparatus 30 in FIG. 2A to bring the substrate 38 into contact with the plating solution 31 in some embodiments. Referring to FIG. 2B, with continued reference to FIG. 2A, the electroplating cell 42 holds the plating solution 31, and the substrate 38 is immersed into the plating solution 31. As such, the electroplating cell 42 is sized based at least in part upon the size of the substrate 38 that will be processed.

Circulation of the plating solution 31 mixes the plating solution 31 and aids in the replenishment of the plating solution 31 adjacent to the surface of the substrate 38. In order to maintain circulation (represented the curved arrows 63) within the electroplating cell 42, the electroplating cell 42 may additionally have an overflow reservoir 56. The overflow reservoir 56 is positioned to receive the plating solution 31 after the plating solution 31 has entered the electroplating cell 42 (e.g., through an entry port 107 at the bottom of the electroplating cell 42) and has circulated through the electroplating cell 42 before entering the overflow reservoir 56. As such, the overflow reservoir 56 may be a weir located adjacent to a top of the electroplating cell 42 so that plating solution 31 can enter the bottom of the electroplating cell 42, circulate around the electroplating cell 42, and make its way up through the electroplating cell 42 before flowing over a side of the electroplating cell 42 and entering the overflow reservoir 56.

The overflow reservoir 56 is connected to the recirculation line 55. The recirculation line 55 receives the plating solution 31 from the overflow reservoir 56 and recirculates the plating solution 31 from the overflow reservoir 56 back to the electroplating cell 42. The recirculation line 55 has a first pump 109 that is utilized to pump the plating solution 31 back into the electroplating cell 42 through, e.g., the entry port 107. The first pump 109 also aids in the mixing of the plating solution 31 within the electroplating cell 42.

The recirculation line 55 may also include a filter 111. The filter 111 is used to remove particulates and other impurities from the plating solution 31 as the plating solution 31 recirculates within the processing system 400. These impurities may include silicate, aggregated surfactant, oil drop by-products of the plating solution 31, and other particles that may form during the processing reactions or else otherwise be in the plating solution 31. The filter 111 size may be dependent at least on the size of the silicates, aggregated surfactant, and the oil drop by-product impurities The recirculation line 55, first pump 109, and filter 111 provides a desired recirculation rate of the plating solution 31 to the electroplating cell 42. This recirculation rate may be used to ensure that the plating solution 31 is properly mixed so that concentration variations (that result from the chemical reactions) at different points within the plating solution 31 are kept at a minimum.

As the process continues, the reactants within the plating solution 31 (e.g., the strong base, the surfactant, and the oxidant) will react and their concentrations will reduce while concentrations of by-products of the reactions (such as silicates) will increase, thereby changing the various rates of reaction and introducing undesired complexity in controlling the processing process. In order to reduce the effects of this reduction, a replenishment system 120 is utilized to monitor the concentrations of the individual components and, if necessary, to replenish the individual components within the plating solution 31 in order to maintain better control over the process. In an embodiment, the replenishment system 120 includes a monitoring system 121 and a controller 500.

The monitoring system 121 is connected to the recirculation line 55 with a bypass line 125 connected between the first pump 109 and the filter 111. To obtain samples of the plating solution 31, a first valve 127 is installed in the bypass line 125 and utilized to remove samples of the plating solution 31 from the recirculation line 55 for analysis. The first valve 127 receives a signal from the controller 500 to open and take a sample at regular intervals.

A cooler 129, e.g., a continuous flow heat exchanger with a cooling medium such as cooling water, is located downstream of the first valve 127 to provide a constant temperature of the samples of the plating solution 31. In some embodiments, the cooler 129 is an active cooling unit, e.g., a refrigeration unit to provide the desired cooling to the samples of the plating solution 31. Any suitable system and method of reducing the temperature of the sample of the plating solution 31 and maintaining the temperature of the samples of the plating solution 31 may be used without departing from the scope of the embodiments.

Once the samples of the plating solution 31 have been cooled down to the appropriate temperature, the samples of the plating solution 31 can be analyzed by a measurement unit 131. The measurement unit 131 includes one or more analysis units, with each of the analysis units utilized to measure one or more components of the plating solution 31. For example, a first analysis unit 117 may analyze the concentration of the oxidant, a second analysis unit 119 may analyze a concentration of the surfactant, and a third analysis unit 151 may analyze a concentration of the strong base.

In some embodiments, the first analysis unit 117 used to measure the oxidant concentration in the samples of the plating solution 31 further includes multiple measuring units, with each one of the individual different measuring units measuring different ranges of concentrations of the oxidant. For example, for measuring higher concentrations of the oxidant, the first analysis unit 117 includes an intensity unit 153 that measures, e.g., an oxidation-reduction potential (ORP) of the samples of the plating solution 31. In some embodiments, the intensity unit 153 is a pH measurement unit, which measures the pH of the samples of the plating solution 31. Either type of intensity unit 153 (e.g., that measures either ORP or pH) and any other suitable type of measuring unit that provides a suitable concentration of the oxidant within the plating solution 31 is utilized, and all such types are fully intended to be included within the scope of the embodiments.

In addition, for measurements that are desired below the sensitivity levels of the intensity unit 153 (e.g., below 100 ppm), the first analyzer 117 also includes a spectrum analyzer 155. In some embodiments, the spectrum analyzer 155 is an optical spectrum analyzer, in which the sample of the plating solution 31 is irradiated with ultraviolet (UV) light, near-infra red (NIR) light, or infra-red (IR) light, and a resulting absorption spectrum is analyzed to determine the concentration of the oxidant within the samples of the plating solution 31.

In some embodiments, the spectrum analyzer 155 measures the concentration of other components that are within the plating solution 31. For example, the spectrum analyzer 155 measures the concentration of reaction by-products, such as silicate in the plating solution 31. This and any other analysis for which the spectrum analyzer 155 is suitable are also utilized to provide information on the plating solution 31.

In some embodiments, a second analyzer 119 measures the concentration of the surfactant within the samples of the plating solution 31. The second analyzer 119 is a spectrum analyzer, and is an optical spectrum analyzer, in which the samples of the plating solution 31 are irradiated with, e.g., ultraviolet (UV) light and a resulting absorption spectrum is analyzed to determine the concentration of the surfactant within the samples of the plating solution 31. In some embodiments, the second analyzer 119 is the spectrum analyzer 155 as described above with respect to the first analyzer 117, although the second analyzer 119 may have a separate spectrum analyzer. Any suitable analyzer may alternatively be utilized to measure the concentration of the surfactant within the samples of the plating solution 31, in some embodiments.

The third analyzer 151 measures the concentration of the strong base within the samples of the plating solution 31. In some embodiments when the strong base is KOH, the third analyzer unit 151 is a pH meter to determine the concentration of KOH in the plating solution 31. However, any other suitable measurement system, such as a refractometer, may alternatively be utilized to measure the concentration of the strong base within the plating solution 31.

Figure 3A:
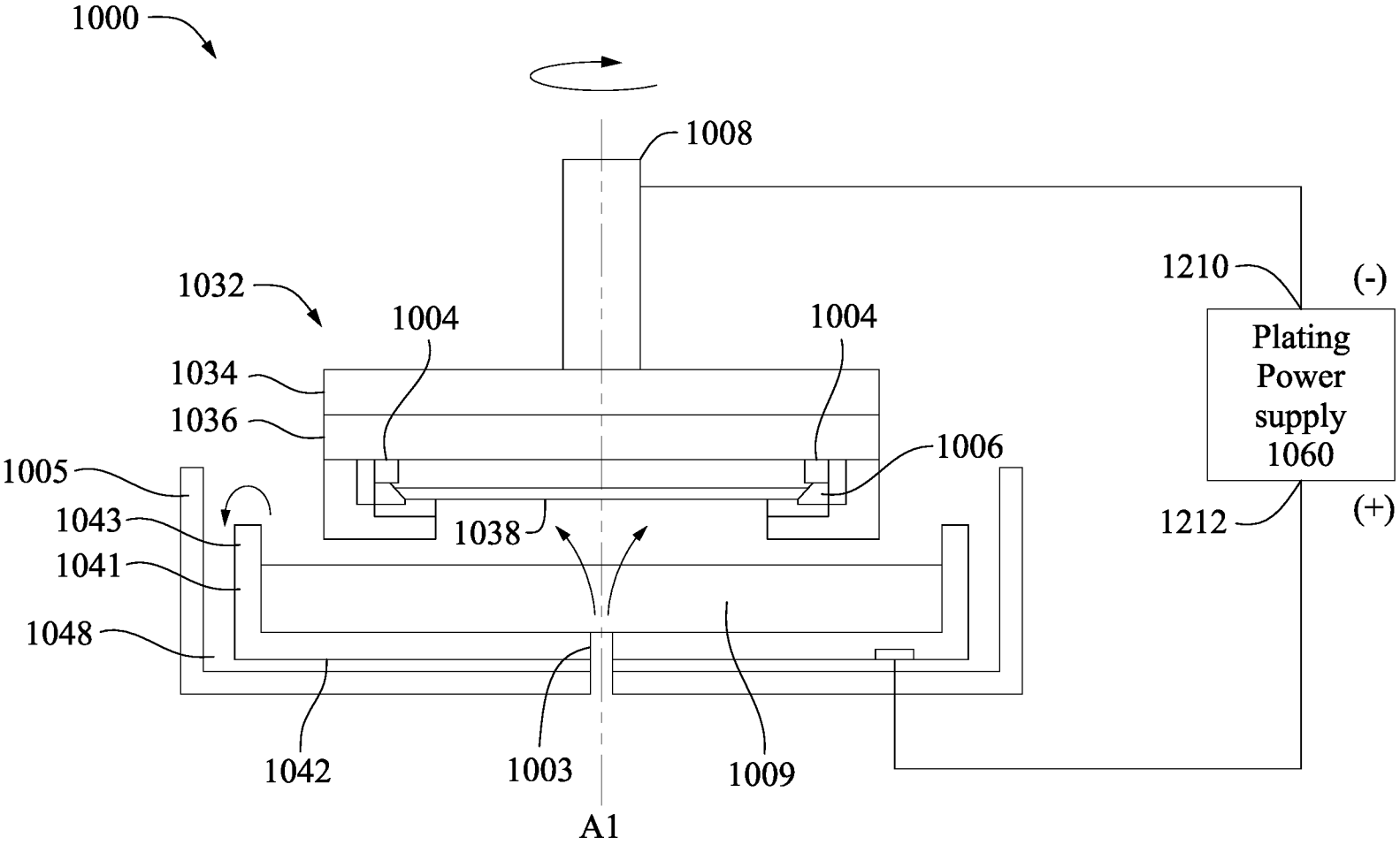
FIG. 3A shows a schematic view of a cell chamber system according to an embodiment of the present disclosure.

FIG. 3A shows a schematic view of a cell chamber system 1000 according to an embodiment of the present disclosure. The cell chamber system 1000 includes a cell chamber 1005 including a plating cell 1042 and a substrate holder 1032 mounted on a rotatable spindle 1008 which allows rotation of the substrate holder 1032. The substrate holder 1032 includes a cone 1034 and a cup 1036. Before the electrochemical plating process starts, a substrate 1038 is mounted in the cup 1036. The substrate holder 1032 and the substrate 1038 are then immersed into the plating cell 1042 containing a plating solution 1009.

The substrate 1038 is positioned in the plating cell 1042 facing down towards the electroplating solution 1009. One or more contacts 1004 are provided to connect the substrate 1038 to a plating power supply 1060 as a cathode of the cell chamber system 1000. An anode 962 (shown in FIG. 3B) is disposed in the plating cell 1042 and is connected to the plating power supply 1060. A snubber 1006 is disposed between the one or more contacts 1004 (connected with cathode 1210) and the substrate 1038. The substrate 1038 is rotated about a cylindrical center axis A1 during the electrochemical plating process. In some embodiments, the plating solution 1009 is an electrolytic solution such as VMS (Virgin Makeup Solution) containing cobalt sulfate ($CoSO_4$), copper sulfate or any other metal electrolytes.

The plating solution 1009 flows into the plating cell 1042 through a plating solution inlet 1003 while substrate 1038 is submerged in the electroplating solution 1009 for the electroplating process. The plating solution 1009 is configured to flow continuously such that the plating solution fills up to a rim 1043 of a weir wall 1041 of the plating cell 1042 and overflows into a plating solution collecting area 1048 of the overflow reservoir outside of the plating cell 1042 in the cell chamber 1005. Overflowed plating solution may then be routed out of the electroplating cell, filtered, and recirculated into the plating bath within the cell chamber.

Figure 3B:
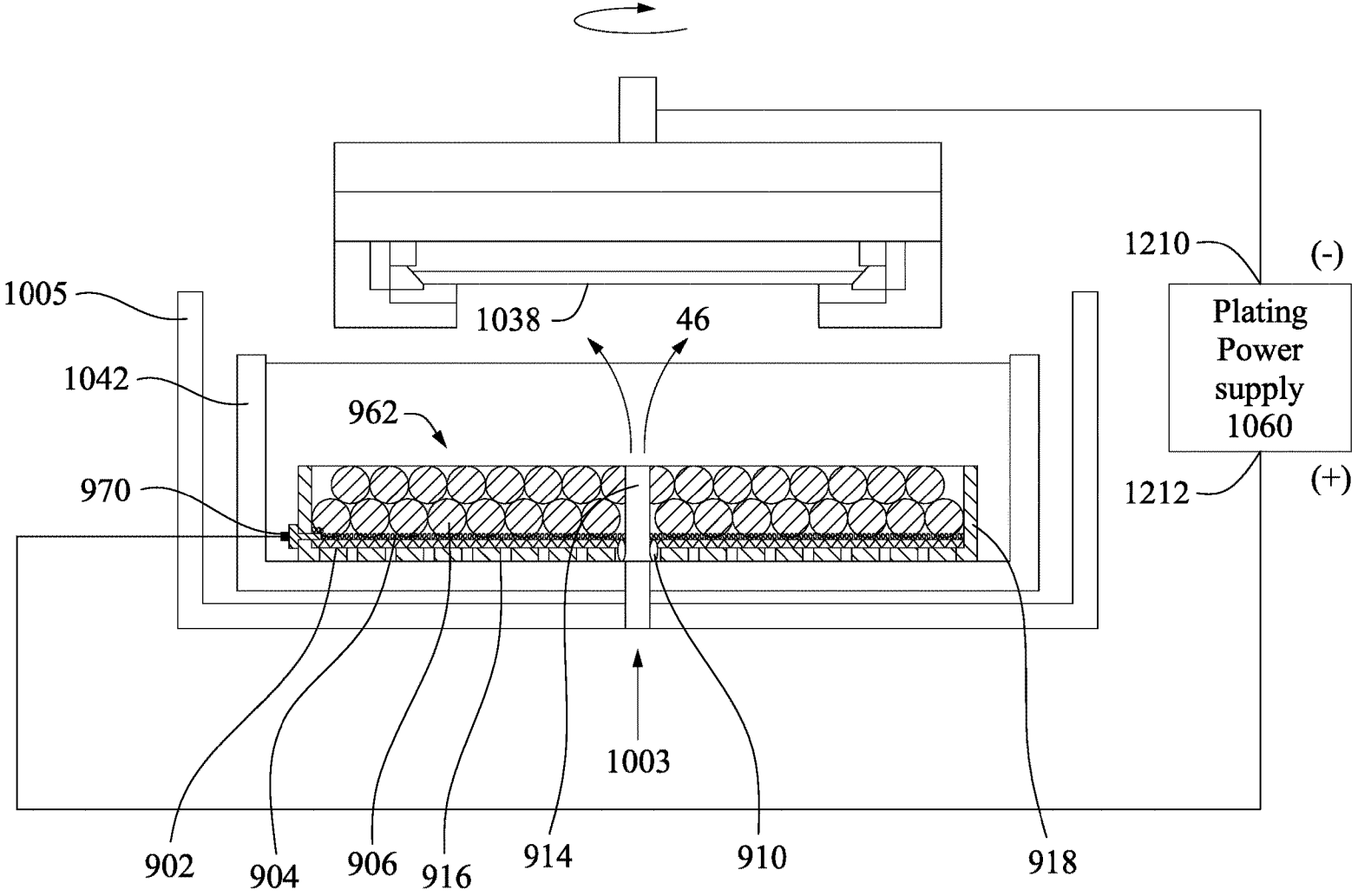
FIG. 3B shows a schematic view of a cell chamber system including an anode according to an embodiment of the present disclosure.

As shown in FIG. 3B, the plating solution is provided to the plating cell 1042 and directed at the substrate 1038 by a jet of the plating solution indicated by arrow 46. FIG. 3B shows a cross-sectional view of anode 962 having the plating solution inlet 1003 passing through the center thereof. The plating solution inlet 1003 includes a tube formed of an electrically insulating material. The anode 962 includes an anode cup 902, a contact 904, and an ion source material 906.

The anode cup 902 is made of an electrically insulating material such as polyvinyl chloride (PVC), polypropylene or polyvinylidene fluoride (PVDF). The anode cup 902 includes a disk-shaped base section 916 having a central aperture 914 through which the plating solution inlet 1003 passes. An O-ring 910 forms the seal between the plating solution inlet 1003 and the base section 916 of the anode cup 902. The anode cup 902 further includes a cylindrical wall section 918 integrally attached at one end (the bottom) to the base section 916.

The contact 904 is made of a relatively inert, electrically conductive material, such as titanium. The contact 904 may be arranged in a variety of forms, e.g. a plate with raised perforations or, as illustrated in FIG. 3B, a mesh. The contact 904 rests on the base section 916 of the anode cup 902. The positive output lead 1212 from power supply 1060 is formed of a relatively inert, electrically conductive material, such as titanium. The positive output lead 1212 is attached to a rod 970 which is also formed of a relatively inert, electrically conductive material, such as titanium. The rod 970 passes through the anode cup 902 to make the electrical connection with the contact 904.

Resting on and electrically connected with the contact 904 is the ion source material 906, for example, copper. The ion source material 906 includes a plurality of granules. These granules include a variety of shapes, including spherical, nugget, flake or pelletized shape. Alternatively, the ion source material 906 is made of a single integral piece, such as a solid disk of material. During the process, the ion source material 906 electrochemically dissolves (e.g. $Cu=Cu^{2+}+2e$) replenishing the ion concentration of the plating solution.

Figure 3D:
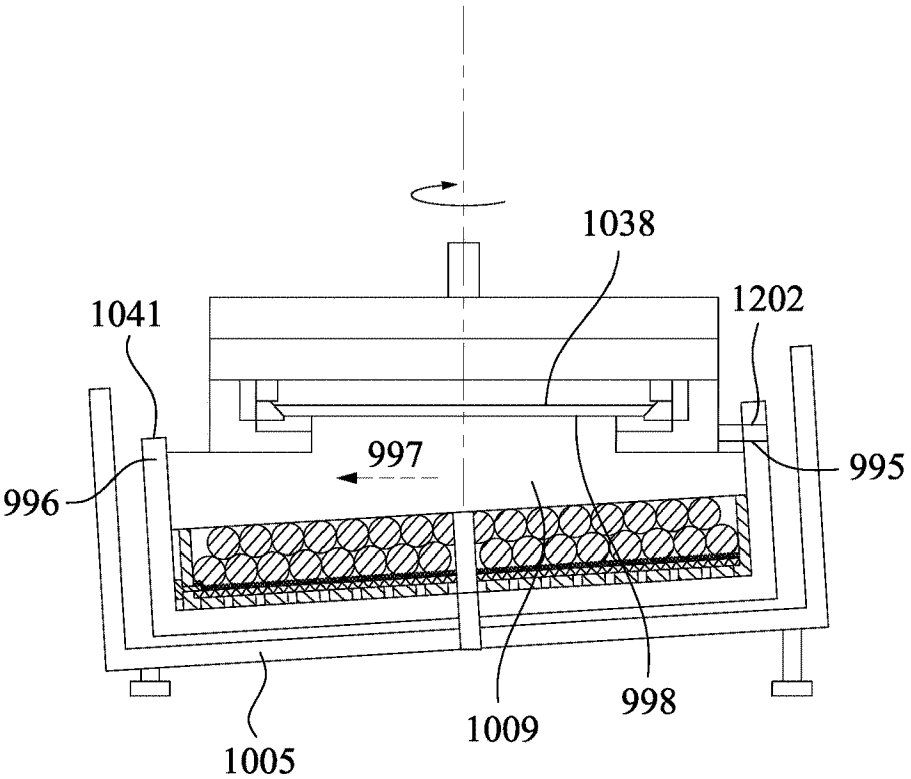
FIGS. 3C and 3D show views of a cell chamber and an inclined cell chamber adjusted by using a leveling screw.
Figure 3C:
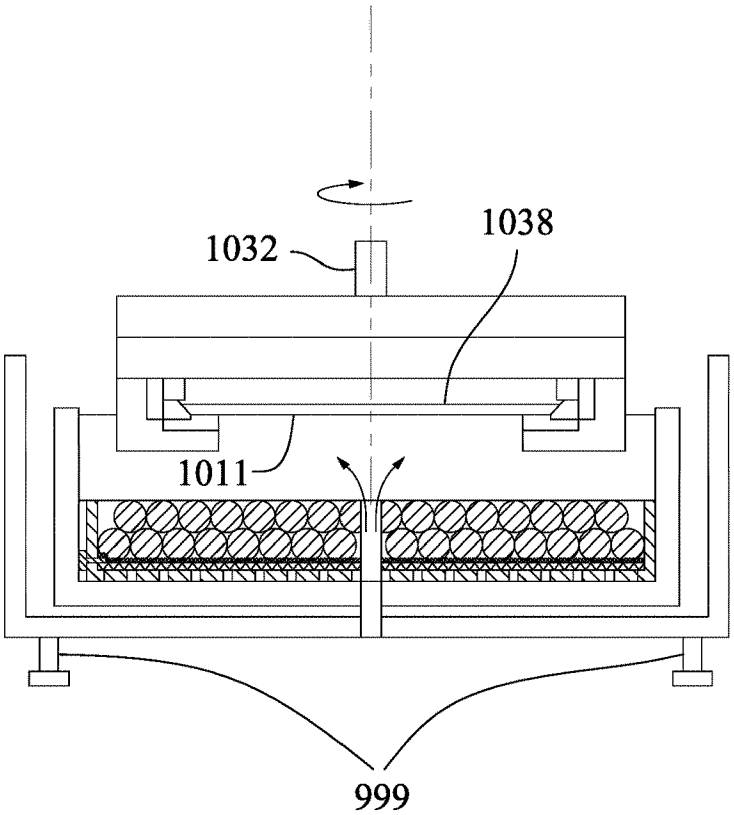

As shown in FIGS. 3C and 3D, the cell chamber 1005 and the substrate holder 1032 are adjusted during the electroplating process to maintain the plating surface 1011 of the substrate 1038 and a bottom of the cell chamber 1005 in a parallel position, so that the substrate 1038 contacts the plating solution 1009 at the plating surface 1011 in a horizontally parallel manner to maintain a uniform thickness/density of the electrochemical plating, thereby achieving the desired defect-free plating. Methods of adjusting the cell chamber 1005 include adjusting leveling screws 999 at a bottom of the cell chamber 1005 to maintain the leveling of the weir wall 1041.

As shown in FIG. 3D, even if the cell chamber 1005 is inclined, a liquid surface 998 of the plating solution 1009 remains horizontal, and thus the plating surface 1011 remains parallel to the liquid surface 998 (if the substrate 1038 is held horizontally). However, when the liquid surface 998 is higher than the lowest portion of the weir wall 1041 (e.g., left side of FIG. 3D), a non-uniform overflow of the plating solution 1009 (e.g., from a right side 995 of the weir wall 1041 towards a left side 996 of the weir wall 1041) occurs, causing a lateral flow as indicated by an arrow 997.

The non-uniform overflow (e.g., lateral flow 997) of the plating solution 1009 in the inclined cell chamber 1005 may decrease uniformity of thickness/density of the deposited film by the plating solution 1009. Accordingly, it is preferable to maintain uniform overflow in all radial directions to achieve a uniform thickness/density of the electrochemical plating. In some embodiments disclosed in the present application, leveling regulators 1202 remove the lateral flow 997 to provide a radially uniform flow of the electrochemical plating solution.

Figure 4A:
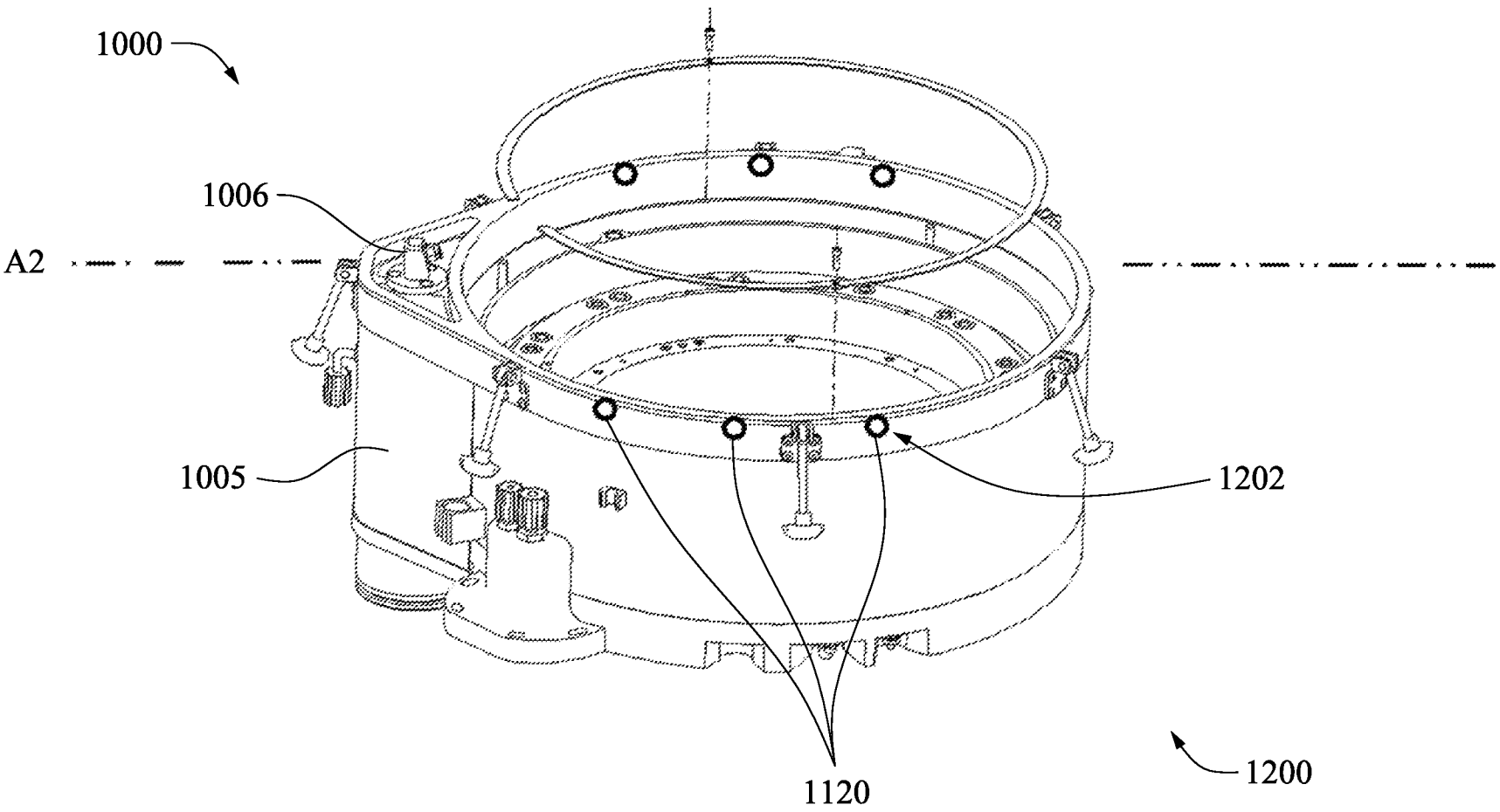
FIG. 4A shows a schematic view of a cell chamber system including a leveling assembly according to an embodiment of the disclosure.

FIG. 4A shows a schematic view of the cell chamber system 1000 according to an embodiment of the present disclosure. In some embodiments, the cell chamber system 1000 includes a leveling assembly 1200. The leveling assembly 1200 includes leveling regulators 1202 disposed on surface portions of the cell chamber 1005. The plurality of openings 1120 are coupled with valves and pumps (shown in FIG. 4B) to achieve a uniform overflow of the plating solution and to remove bubbles and/or any by-products from the processing solution, in some embodiments. In some embodiments, the leveling regulators 1202 are located symmetrically in the surface portions of the cell chamber 1005 along a reference axis A2 including a reference point 1006 from a top view.

Figure 4B:
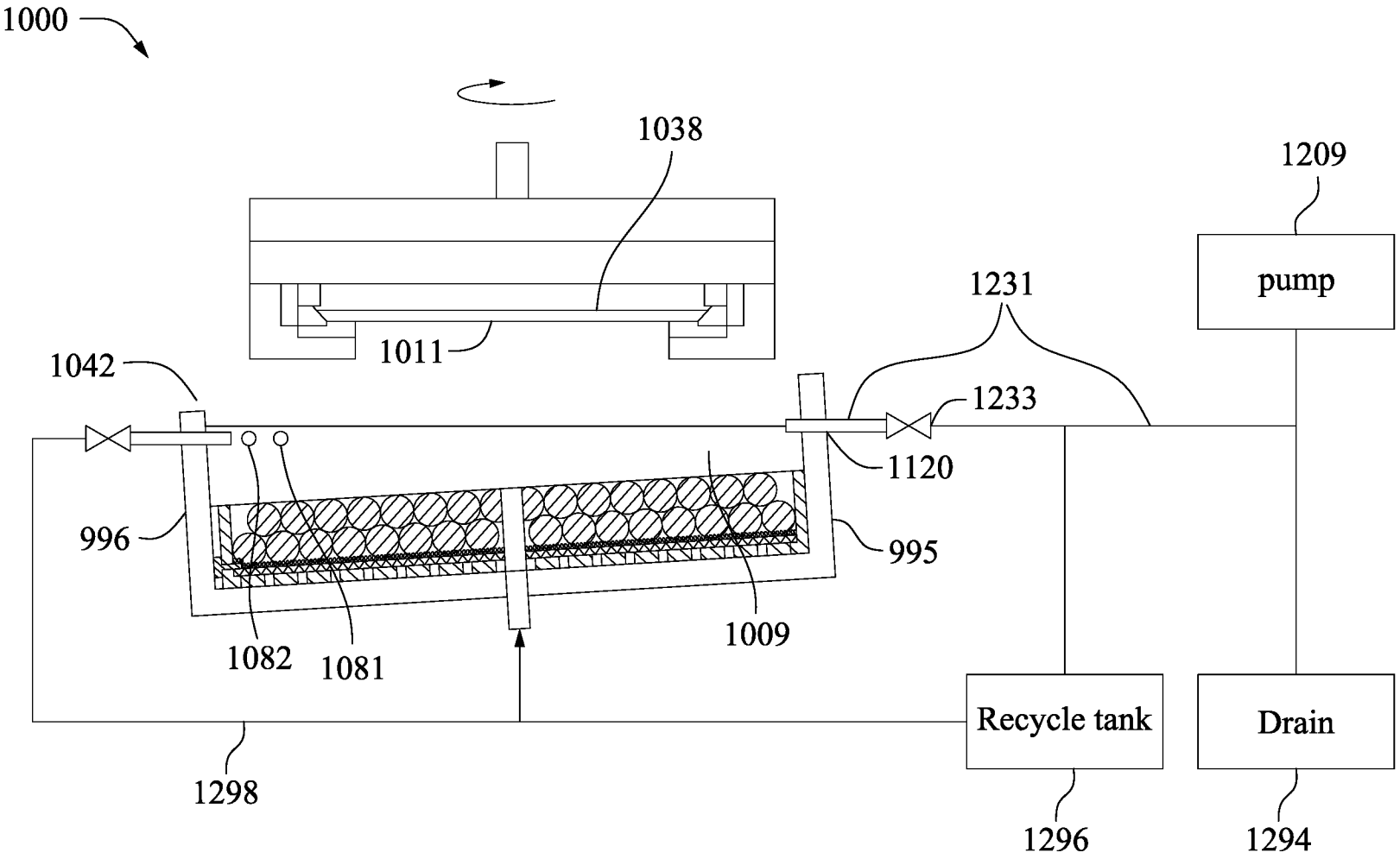
FIG. 4B shows another schematic view of a cell chamber system according to an embodiment of the disclosure.

As shown in FIG. 4B, in some embodiments, each of the plurality of openings 1120 are coupled with a control valve 1233 and a pump 1209 via a pipe 1231 to achieve an uniform overflow of the plating solution 1009 and to remove the bubbles 1081 and/or any by-products 1082 from the plating solution 1009. In some embodiments, the overflown plating solution 1009 through the leveling regulators 1202 is recirculated via a recirculation line 1298. In some embodiments, the process solution 1009 is stored in a recycle tank 1296 and supplied back to the plating cell 1042.

In some embodiments, the overflown process solution 1009 is directed to a drain 1294. As also discussed with reference to FIG. 3D, when the substrate 1038 is rotated during the electrochemical plating process, the rotation of the substrate causes a rotation of the plating solution 1009. If the cell chamber 1005 is inclined, the rotating movement of the plating solution 1009 becomes asymmetric due to the lateral flow 997 (shown in FIG. 3D) causing the non-uniform thickness/density of the electrochemical plating by the plating solution 1009. In some embodiments disclosed in the present application, the lateral flow 997 is reduced/removed by symmetric rotation of the plating solution 1009. The symmetric rotation can be achieved by adjusting a flow rate by using the control valve 1233 and a pump 1209 via a pipe 1231 to achieve a radially uniform flow of the plating solution 1009 within the cell chamber system 1000. For example, if the plating cell 1042 is inclined with the right side 995 higher than the left side 996 as shown in FIG. 4B, the valve (and/or pump) at the left side is adjusted to reduce the flow through the left side port and/or the valve at the right side is adjusted to increase the flow through the right side port. By adjusting the valves, it is possible to equalize the overflow amounts between left side and right side, thereby eliminating the lateral flow and maintaining a radially uniform overflow of the plating solution.

In some embodiments, a feedback control is used to maintain a radially uniform overflow of the plating solution. The feedback controller is configured to control the flow regulator such that overflow amounts of the plating solution flowing out through the plurality of openings are substantially equal to each other. Here, "substantially equal" means that a difference is less than 10%.

Figure 4D:
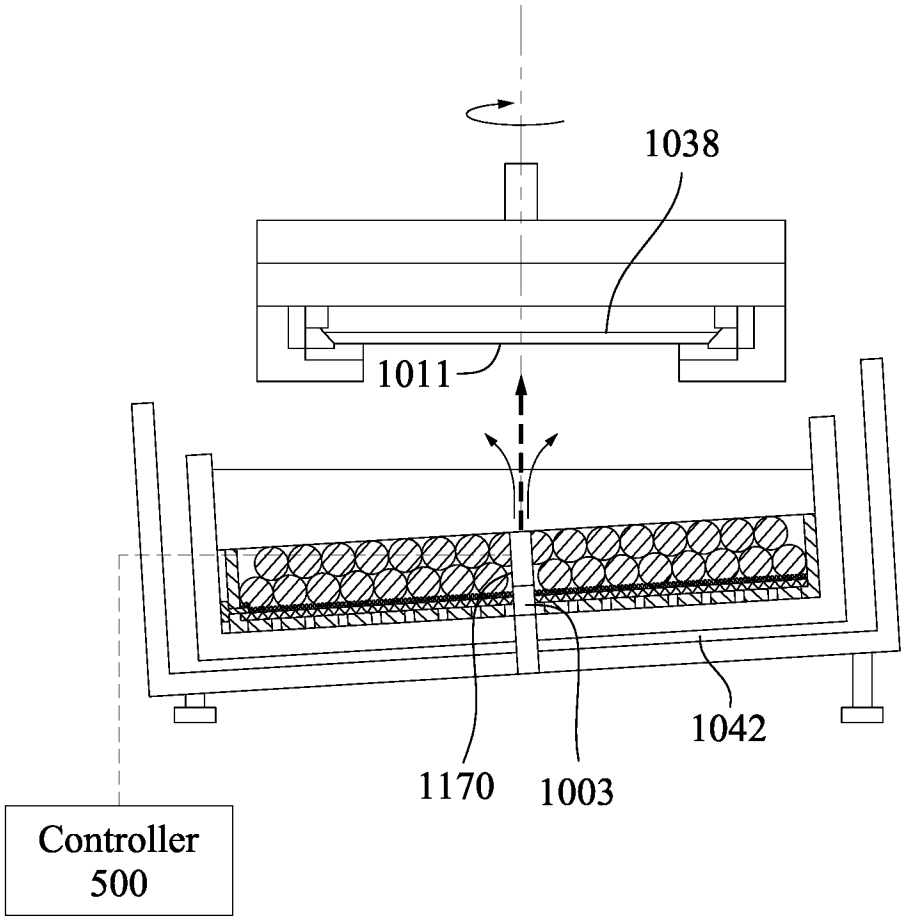
FIG. 4D shows a schematic view of an inclined cell chamber including a directional positioner according to an embodiment of the disclosure.
Figure 4C:
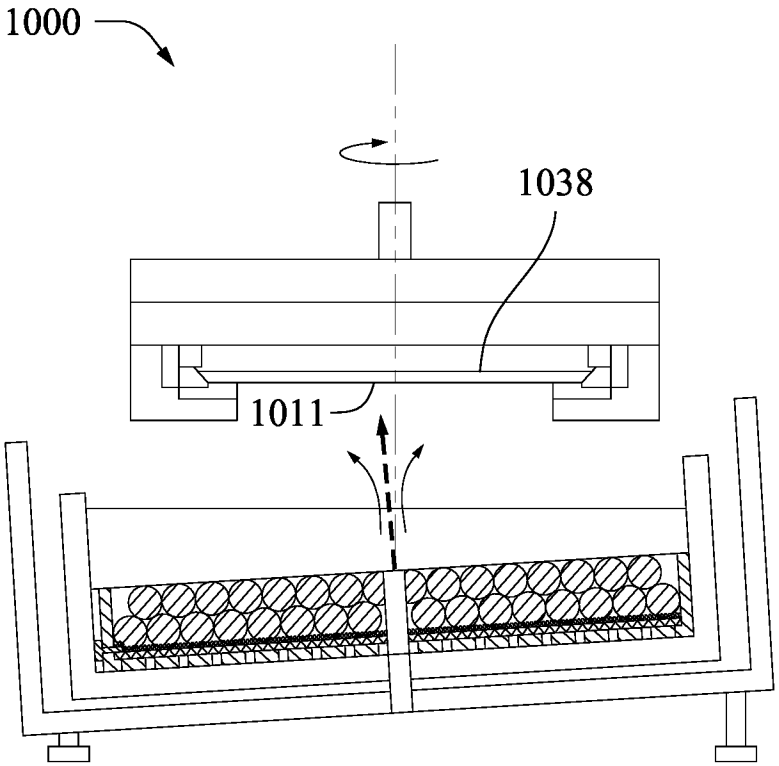
FIG. 4C shows a schematic view of an inclined cell chamber according to an embodiment of the disclosure.

As shown in FIGS. 4C and 4D, in some embodiments, the cell chamber system 1000 further includes a directional positioner 1170. The directional positioner 1170 is configured to change a two-dimensional direction and/or three-dimensional rotation of the plating process solution 1009 by inserting a mechanical device into the plating solution inlet 1003, such that plating process solution 1009 is directed perpendicularly towards a center of the plating surface 1011 of the substrate 1038. In some embodiments, the directional positioner 1170 "pops-up" from the plating solution inlet 1003 when needed and is substantially concealed within the plating solution inlet 1003 when not in use. The controller 500 selectively adjusts the angle of the directional positioner 1170 via an adjustable angle portion of the directional positioner in some embodiments. The adjustable angle portion includes a body that is slidably received within the cell chamber system 1000 and has an inwardly projecting annular flange which bears against any appropriate type of sealing.

Figure 5A:
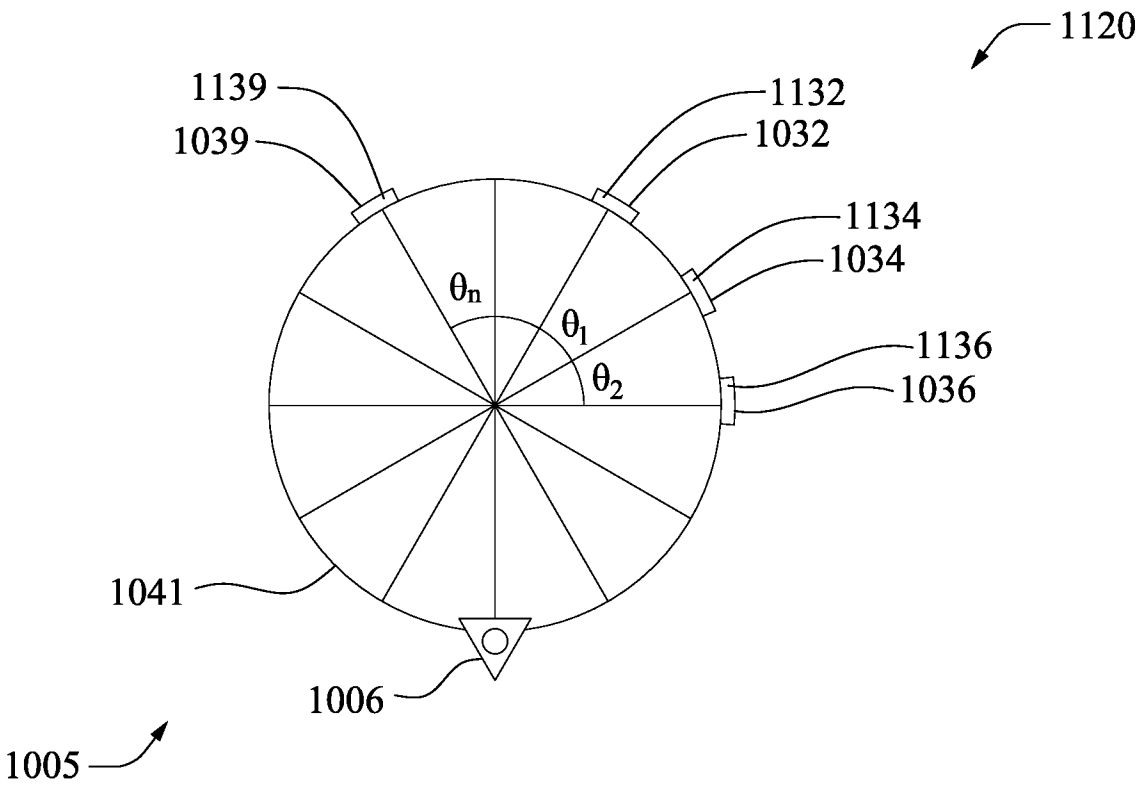
FIG. 5A is a schematic top view of the cell chamber according to an embodiment of the present disclosure.

FIG. 5A shows a top view of the cell chamber according to an embodiment of the present disclosure. In some embodiments, as can be seen from the top view, the plurality of openings 1120 include openings 1132, 1134, 1136 and 1139 arranged in a clock layout. However, any appropriate number and/or configuration regarding the openings is contemplated and is not limited in this regard. In some embodiments, the openings 1132, 1134, 1136 and 1139 are located symmetrically in the surface portions of the weir wall 1041 of the cell chamber 1005. Each of the surface portions 1032, 1034, 1036, 1039 include central angles $\theta_1$, $\theta_2$, $\theta_3$, . . . , and $\theta_n$, among the surface portions. In some embodiments shown in FIG. 4D, the central angles $\theta_1$, $\theta_2$, $\theta_3$, . . . , and $\theta_n$ are in a range from about 25 degrees to about 35 degrees. In some embodiments, the central angles $\theta_1$, $\theta_2$, $\theta_3$, . . . , and $\theta_n$ are the same. In some embodiments, a diameter of the openings 1132, 1134, 1136, 1139 ranges from about 20 mm to about 40 mm. In some embodiments, a diameter of the openings 1132, 1134, 1136, 1139 ranges from about 25 mm to about 35 mm. In a particular embodiment, a diameter of the openings 1132, 1134, 1136, 1139 is about 30 mm. The openings 1132, 1134, 1136, 1139 of the cell chamber system 1000 may be equally divided into 12 surface areas. In some embodiments, angles $\theta_1$, $\theta_2$, $\theta_3$, . . . , and $\theta_n$ may be different. However, any appropriate number and/or angle configuration regarding the openings is contemplated and is not limited in this regard.

Figure 5B:
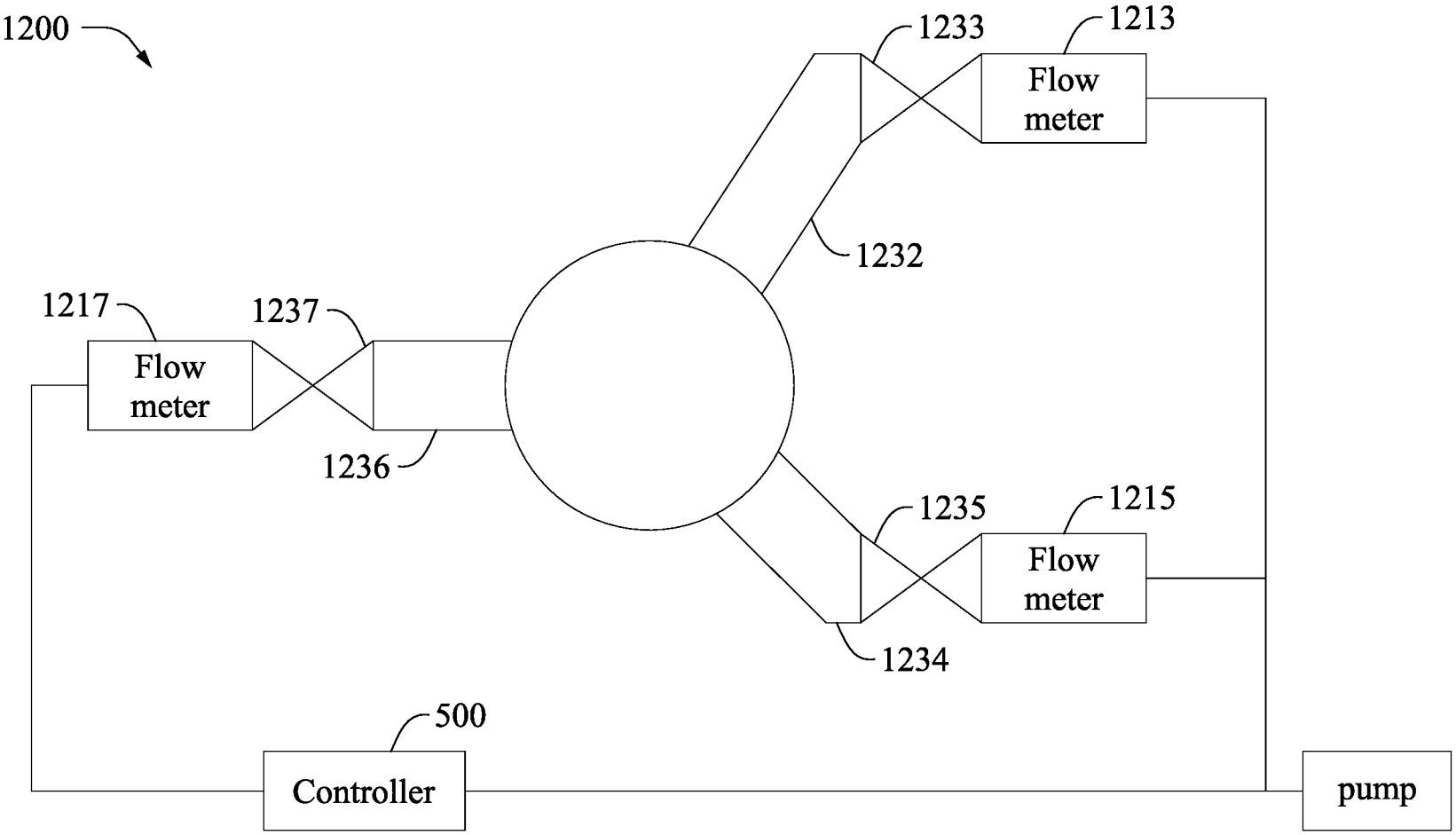
FIG. 5B schematically illustrates an exemplary layout of a cell chamber including a leveling assembly according to various embodiments.

For example, in some embodiments, FIG. 5B schematically illustrates a schematic view of three control valves. In some embodiments, three pipes 1232, 1234, 1236 having similar lengths and the same number of bends are provided, so that flow rates from all three pipes are adjustable by the controller 500, are operatively connected to flow meters 1213, 1215, 1217. In FIG. 5B, all three pipes are connected to a single pump. In some embodiments, the three pipes are individually connected to three separate pumps.

In some embodiments, as shown in FIG. 5B, each of the three pipes 1232, 1234, 1236 are connected to flow meters 1213, 1215, 1217 via flow control valves 1233, 1235, 1237, respectively. The lateral flow 997 (shown in FIG. 3D) can be reduced/removed and the overflow of the plating solution 1009 can be made symmetric by adjusting the flow rate by using the control valves 1233, 1235, 1237, respectively, based on the flow rated measured by the flow meters 1213, 1215, 1217. This flow rate is controlled by using the flow control valves 1233, 1235, 1237. In some embodiments, the controller 500 is operatively connected to the flow meters 1213, 1215, 1217, the flow control valves 1233, 1235, 1237 and the three separate pumps. The controller 500 controls the operations of the flow control valves 1233, 1235, 1237 based on the measured flow rates of each of the flow meters 1213, 1215, and 1217, respectively. In some embodiments, the controller 500 includes a processor and a memory storing a control program and when the control program is executed by the processor, the control program causes the processor to perform intended operations. In some embodiments, the controller 500 includes a microcomputer.

Figures 6A, 6B, 6C:
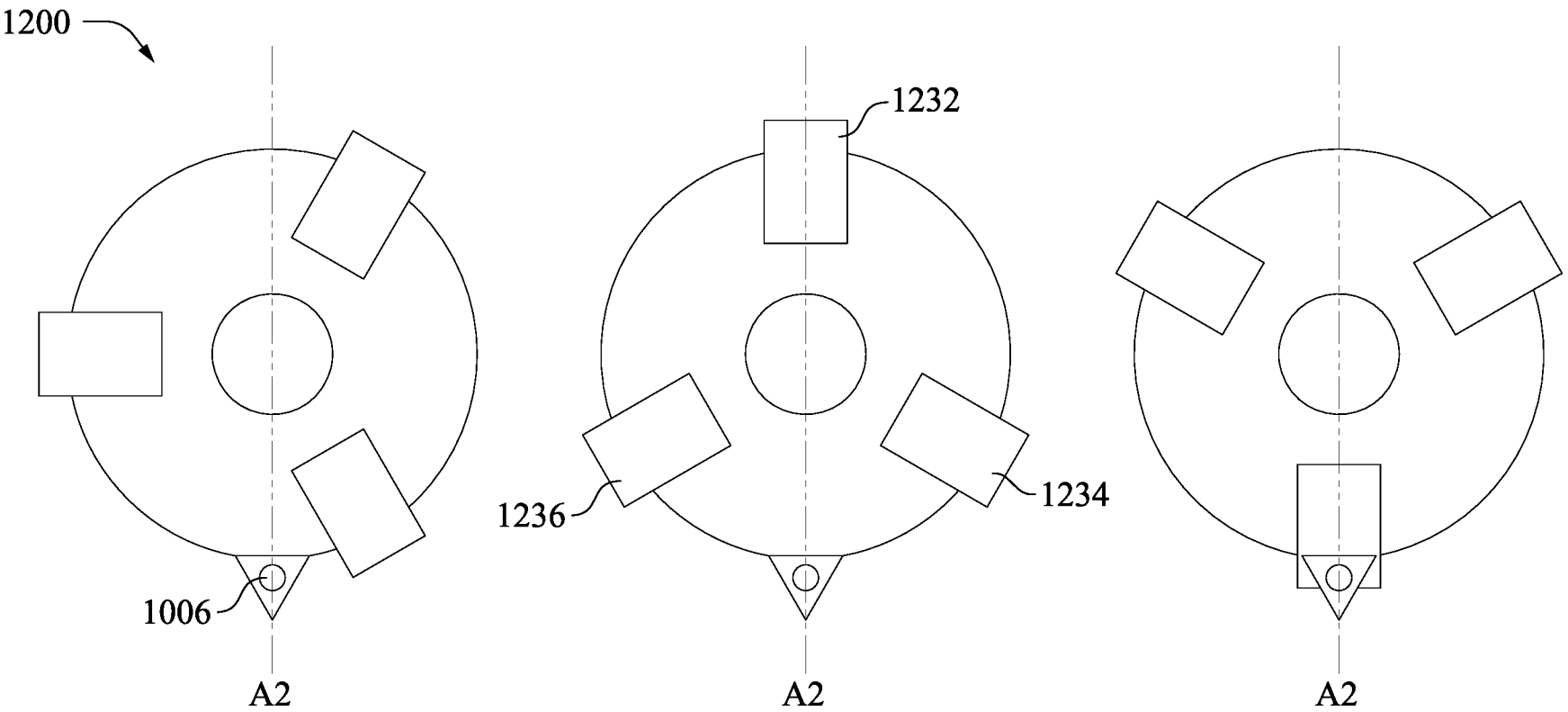
FIGS. 6A, 6B and 6C show some exemplary layouts of a cell chamber including a leveling assembly according to various embodiments.

As shown in FIGS. 6A, 6B and 6C, the present system may utilize any appropriate configuration of the leveling assembly or the three pipes 1232, 1234, 1236 relative to the reference axis A2 including the configurations also illustrated in FIG. 4A.

Figure 7B:
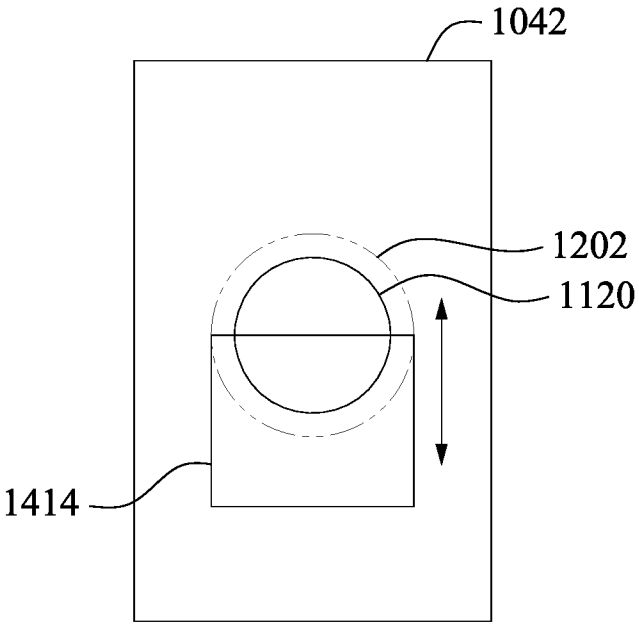
FIGS. 7A, 7B and 7C show a cell chamber system with a leveling assembly including a slit control mechanism according to various embodiments.
Figure 7A:
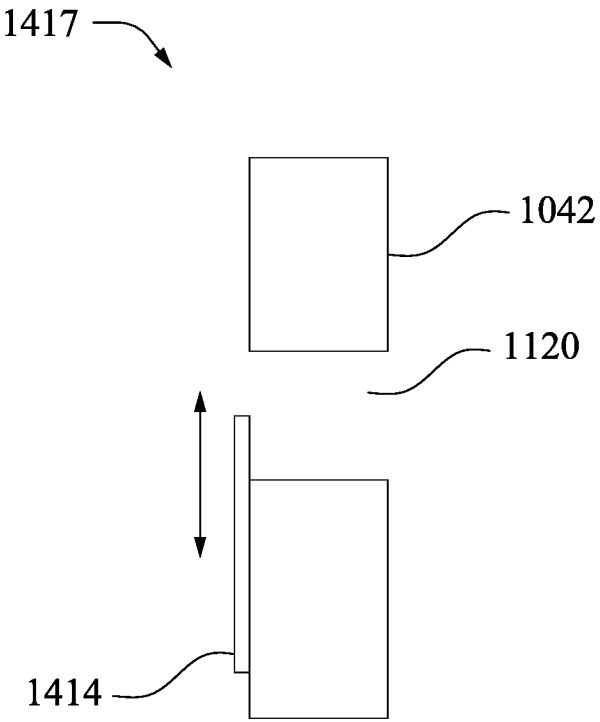
Figure 7C:
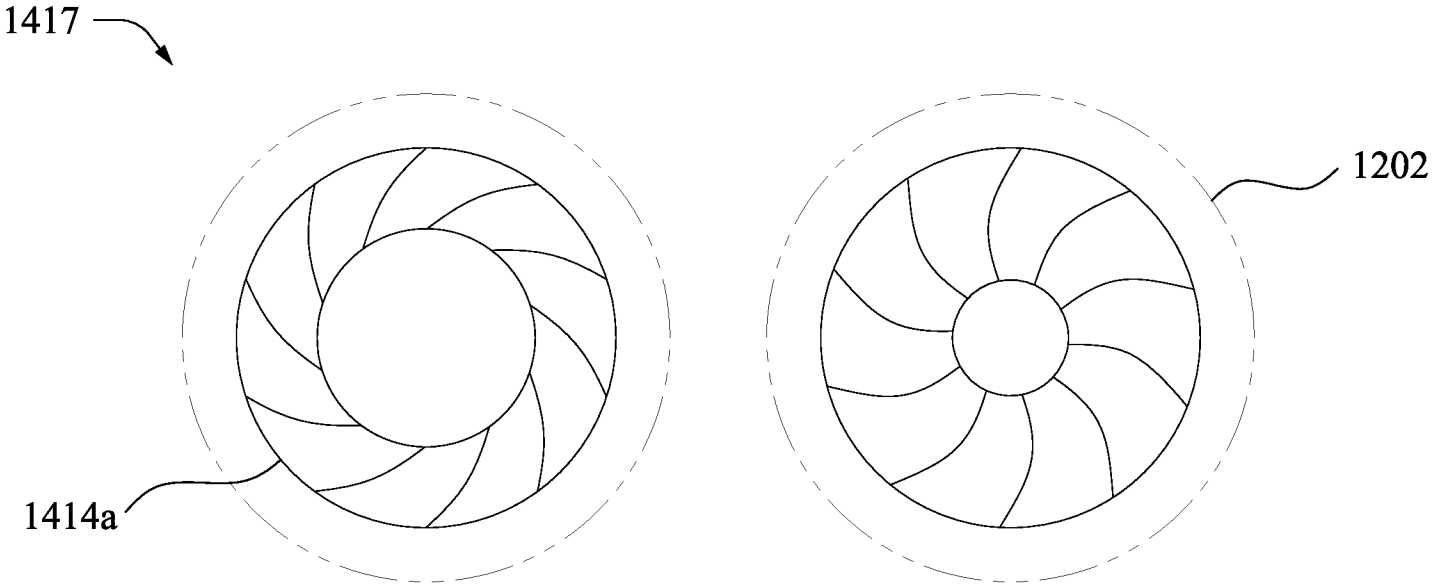

As shown in FIGS. 7A, 7B and 7C, in one or more of the foregoing and following embodiments, the leveling regulators 1202 are arranged with a slit control mechanism 1417 as shown in FIGS. 7A and 7B.

The slit control mechanism 1417 (also referred to herein as "auto slit") controls the flow rate of the plating solution exiting the leveling regulators of the cell chamber. In an embodiment, a slit 1414 is slidably attached with the plurality of openings 1120 of the plating cell 1042. In some embodiments, the slit is slidably disposed within the leveling regulators 1202. In some embodiments, as depicted in FIGS. 7A and 7B, the slit control mechanism 1417 allows an adjustable orifice having a variable diameter of the plurality of openings 1120. For example, in an embodiment of two leveling regulators 1202 shown in a cross-sectional view of FIG. 4B, a differential flow rate is a difference of the flow rates between the right side 995 and the left side 996 of the weir wall 1041. In an embodiment of three leveling regulators 1202 shown in FIG. 5B, the differential flow rate is a relative difference of the flow rates among the flow meters 1213, 1215, and 1217. When the controller 500 determines that the differential flow rate of the plating solution measured at the flow meters is lower than the acceptable range, the controller 500 moves the slit control mechanism 1417 such that a smaller portion of the slit 1414 covering the plurality of openings 1120 is provided in the path of the plating solution exiting the leveling regulators 1202, allowing more plating solution to flow through the leveling regulators 1202 and increasing the measured flow rate. On the other hand, if it is determined that the differential flow rate of the plating solution measured at the leveling regulators 1202 is higher than the acceptable range, the controller 500 moves the slit control mechanism 1417 such that a larger portion of the slit 1414 covering the plurality of openings 1120 is provided in the path of the plating solution exiting the leveling regulators 1202, thereby reducing the measured flow rate.

In some embodiments, as depicted in FIG. 7C the auto slit 1417 includes an iris diaphragm 1414*a* disposed at the leveling regulators 1202. The slit control mechanism 1417 in such embodiments functions by changing the total flow rate of the plating solution through the iris diaphragm 1414*a*. For example, if the controller 500 determines that the measured differential flow rate needs to be higher, the iris diaphragm 1414' is actuated to increase the aperture size, thereby allowing more the plating solution to pass through the leveling regulators 1202 and resulting in an increase in the measured differential flow rate. On the other hand, if the measured differential flow rate needs to be reduced, the controller 500 actuates the iris diaphragm 1414' to reduce the aperture size resulting in a reduction in the measured flow rate.

Figure 8:
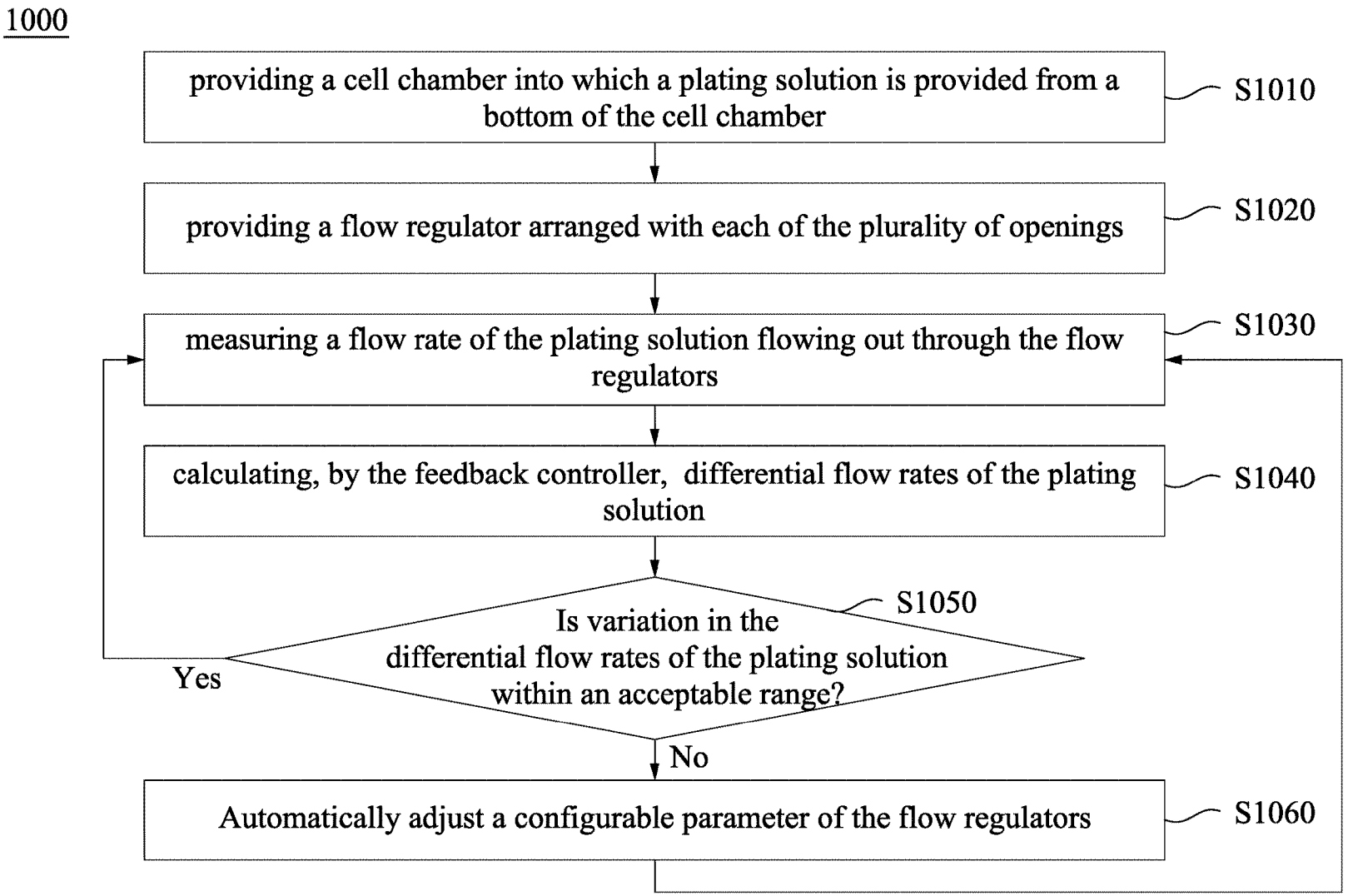
FIG. 8 illustrates a flow-chart of a method of controlling the cell chamber system with the feedback controller in accordance with an embodiment of the present disclosure.

FIG. 8 illustrates a flow-chart of a method 1000 of controlling the cell chamber system 1000 with a feedback controller of an electrochemical plating apparatus in accordance with an embodiment of the present disclosure. The method includes, at S1010, providing a cell chamber into which a plating solution is provided from a bottom of the cell chamber. The cell chamber includes a sidewall and a plurality of openings passing through the sidewall. The method also includes, at S1020, providing a flow regulator arranged with each of the plurality of openings. Then, the method includes, at 51030, measuring a flow rate of the plating solution flowing out through the flow regulators. In some embodiments, a configurable parameter is a differential flow rate measurement. At S1040, a differential flow rate of the plating solution is calculated by the feedback controller. In some embodiments, the feedback controller generates a notification based on new differential flow rate measurement information indicating the differential flow rate is within the acceptable mass measurement range At S1050, it is determined whether the differential flow rate of the plating solution is within an acceptable range. In some embodiments, the flow regulator includes a logic circuit programmed to generate a predetermined signal when the detected variation in differential flow rate measurement is not within an acceptable range. For example, a signal is generated when the detected variation in differential flow rate measurement is less than a certain threshold value. The threshold value of variation in differential flow rate measurement is, for example, +/−5% of an expected minimum variation in differential flow rate measurement.

If the variation in differential flow rate measurement flowing out through the flow regulators is not within the acceptable range, at S1060, a configurable parameter of the flow regulators is automatically adjusted to increase or decrease the variation in differential flow rate measurement flowing out through the flow regulators to bring the variation in differential flow rate measurement of an overflow within the acceptable range.

Figure 9A:
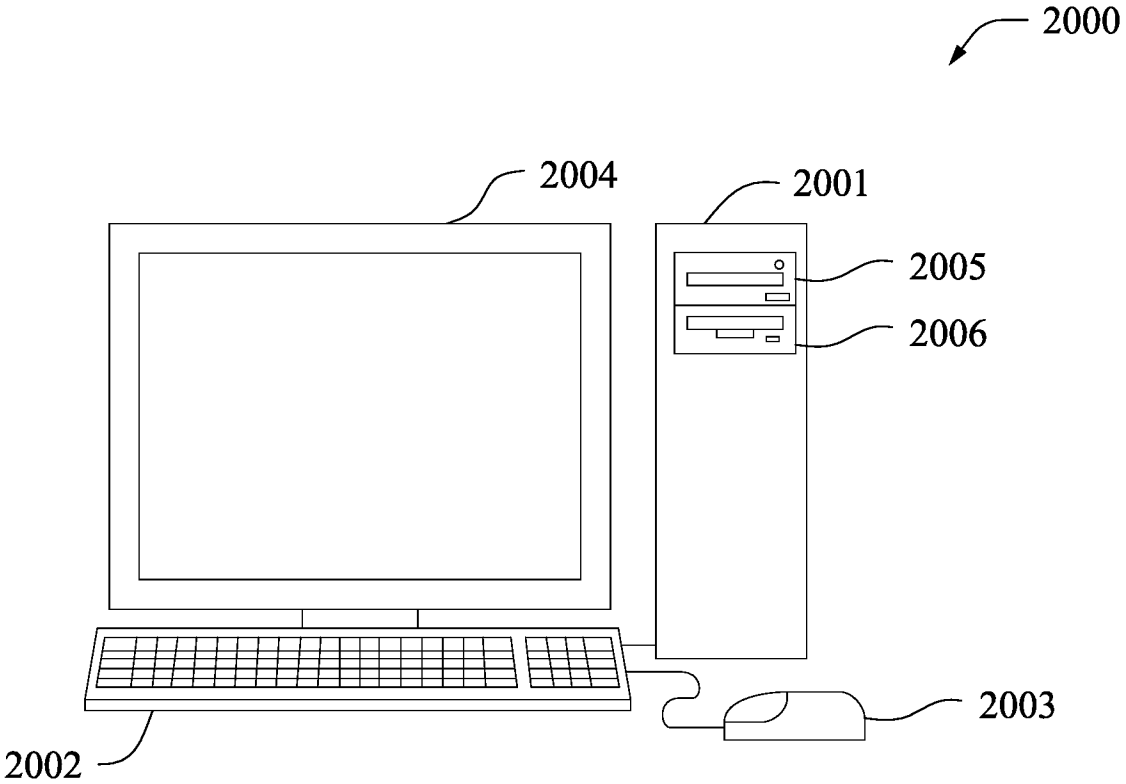
FIGS. 9A and 9B illustrate a controller in accordance with some embodiments of the disclosure.
Figure 9B:
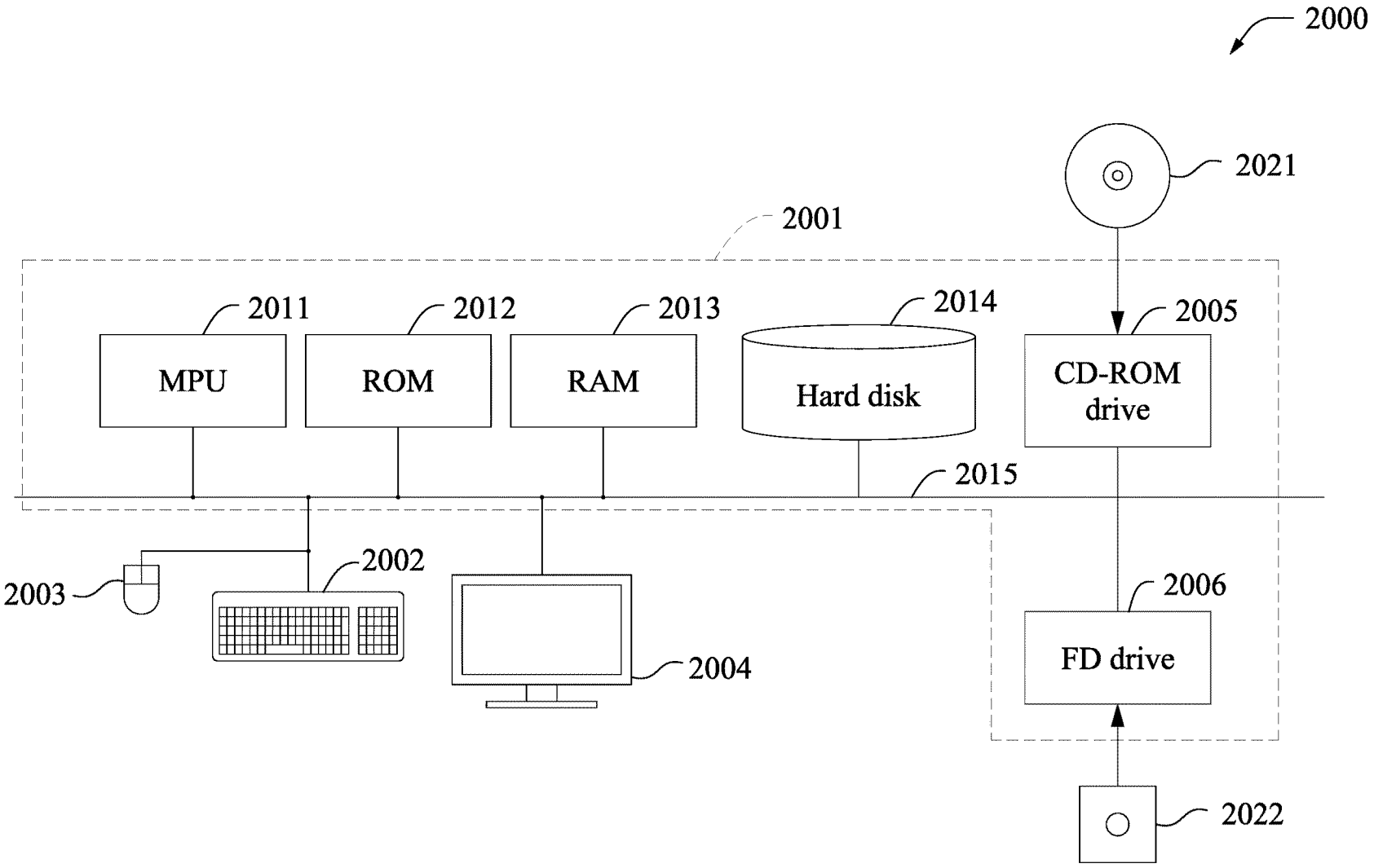

FIGS. 9A and 9B illustrate a configuration of the controller 500 in accordance with some embodiments of the disclosure. In some embodiments, a computer system 2000 is used as the controller 500. In some embodiments, the computer system 2000 performs the functions of the controller as set forth above.

FIG. 9A is a schematic view of a computer system. All of or a part of the processes, method and/or operations of the foregoing embodiments can be realized using computer hardware and computer programs executed thereon. In FIG. 9A, a computer system 2000 is provided with a computer 2001 including an optical disk read only memory (e.g., CD-ROM or DVD-ROM) drive 2005 and a magnetic disk drive 2006, a keyboard 2002, a mouse 2003, and a monitor 2004.

FIG. 9B is a diagram showing an internal configuration of the computer system 2000. In FIG. 9B, the computer 2001 is provided with, in addition to the optical disk drive 2005 and the magnetic disk drive 2006, one or more processors, such as a micro processing unit (MPU) 2011, a ROM 2012 in which a program such as a boot up program is stored, a random access memory (RAM) 2013 that is connected to the MPU 2011 and in which a command of an application program is temporarily stored and a temporary storage area is provided, a hard disk 2014 in which an application program, a system program, and data are stored, and a bus 2015 that connects the MPU 2011, the ROM 2012, and the like. Note that the computer 2001 may include a network card (not shown) for providing a connection to a LAN.

The program for causing the computer system 2000 to execute the functions of an apparatus for controlling the apparatus in the foregoing embodiments may be stored in an optical disk 2021 or a magnetic disk 2022, which are inserted into the optical disk drive 2005 or the magnetic disk drive 2006, and transmitted to the hard disk 2014. Alternatively, the program may be transmitted via a network (not shown) to the computer 2001 and stored in the hard disk 2014. At the time of execution, the program is loaded into the RAM 2013. The program may be loaded from the optical disk 2021 or the magnetic disk 2022, or directly from a network. The program does not necessarily have to include, for example, an operating system (OS) or a third party program to cause the computer 2001 to execute the functions of the controller 500 in the foregoing embodiments. The program may only include a command portion to call an appropriate function (module) in a controlled mode and obtain desired results.

In various embodiments, one or more leveling regulators are provided in the cell chamber to remove bubbles or any by-products from the processing solution so as to provide a more radially uniform flow. Such radially uniform flow prevents uneven electrochemical plating results on the wafer, thereby increasing the yield of the wafers and increasing the throughput of the chemical process system as well as reducing the cost of maintenance of the semiconductor manufacturing process.

An embodiment of the disclosure is an electrochemical plating apparatus for depositing a conductive material on a wafer. The apparatus includes a cell chamber, a plurality of openings passing through a sidewall of the cell chamber, and a flow regulator arranged with each of the plurality of openings. A plating solution is provided from a bottom of the cell chamber. The flow regulator is configured to regulate an overflow amount of the plating solution flowing out through the each of the plurality of openings. In some embodiments, the electrochemical plating apparatus includes a controller to control the flow regulator such that overflow amounts of the plating solution flowing out through the plurality of openings are substantially equal to each other. In some embodiments, the flow regulator includes a valve. In some embodiments, the controller controls the flow regulator using a differential flow rate of the plating solution measured at the flow regulator as a control parameter. In some embodiments, the flow regulator includes an adjustable slit through which the plating solution passes. In some embodiments, a slit width of the adjustable slit is controlled to regulate an overflow amount of the plating solution. In some embodiments, the adjustable slit includes an iris diaphragm. In some embodiments, the plurality of openings are symmetrically arranged in a plane perpendicular to a cylindrical center axis of the cell chamber. In some embodiments, the apparatus includes a feedback controller configured to maintain a radially uniform overflow of the plating solution. In some embodiments, each of the plurality of openings is connected to a separate pumping module. In some embodiments, the apparatus includes a directional positioner configured to introduce the plating solution to the cell chamber such that plating solution is directed perpendicularly towards a center of the plating surface of the wafer.

Another embodiment of the disclosure is a method of regulating an electrochemical plating process. The method includes providing a plating solution from a bottom of a cell chamber. A plurality of openings pass through a sidewall of the cell chamber and a flow regulator is arranged with each of the plurality of openings. Then, a flow rate of the plating solution is measured flowing through the flow regulator. Subsequently, a feedback controller calculates differential flow rate of the plating solution. Then, it is determined whether a variation in the differential flow rate of the plating solution is within an acceptable range. In response to determination that the variation in differential flow rate measurement is not within the acceptable range, a configurable parameter of the flow regulator is automatically adjusted to set the variation in differential flow rate measurement within the acceptable range. When the configurable parameter of the flow regulator is automatically adjusted, in some embodiments, an adjustable slit of the flow regulator is adjusted through which plating solution passes. Before measuring a flow rate of the plating solution, in some embodiments, a wafer is rotated to cause a rotating movement of the plating solution. In some embodiments, the feedback controller generates a notification based on a new differential flow rate measurement information indicating the differential flow rate is within the acceptable mass measurement range.

According to another aspect of the present disclosure is a method of manufacturing a semiconductor wafer. The method includes providing a plating apparatus that comprises a wafer holder, a power supply, and a cell chamber. The wafer holder is configured to hold and rotate the wafer. The power supply is coupled with electrodes configured to apply an electric charge to the wafer. A plating solution is provided from a bottom of the cell chamber. Then, the leveling assembly including flow regulators is provided to a plurality of openings of the cell chamber. The leveling assembly is then maintaining a radially uniform overflow of the plating solution of the cell chamber. In some embodiments, a diameter of the plurality of openings ranges from 20 mm to 40 mm. In some embodiments, each of the flow regulators includes an adjustable slit through which the plating solution passes. In some embodiments, each of the flow regulators is connected to a separate pumping module. In some embodiments, a feedback controller is configured to generate a notification based on new differential flow rate measurement information.

The foregoing outlines features of several embodiments or examples so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments or examples introduced herein. Those skilled in the art should also realize that such equivalent constructions do not depart from the spirit and scope of the present disclosure, and that they may make various changes, substitutions, and alterations herein without departing from the spirit and scope of the present disclosure

What is claimed is:

1. A method of electrochemical plating on a wafer, comprising:

providing a plating solution in a cell chamber, wherein the plating solution enters the cell chamber from an entry port of the cell chamber;

flowing the plating solution through two or more openings in a sidewall of the cell chamber out of the cell chamber;

regulating flow of the plating solution through the two or more openings based on determining whether a differential flow rate between flow rates of the plating solution through at least two openings of the two or more openings is within an acceptable range;

sampling a portion of the plating solution; and determining concentration of a parameter of the sampled plating solution.

2. The method of claim 1, wherein a flow regulator is arranged with each one of the two or more openings such that the plating solution flowing through the flow regulator of each one of the two or more openings, wherein a controller is coupled to the flow regulator of each one of the two or more openings, wherein the controller determines the differential flow rate between the flow rates of the plating solution through at least two openings of the two or more openings.

3. The method of claim 1, wherein the entry port is located at a bottom of the cell chamber.

4. The method of claim 2, wherein the flow rates of the plating solution through each one of the two or more openings are substantially equal.

5. The method of claim 2, wherein the flow regulator of each one the two or more openings includes an adjustable slit through which the plating solution passes, the method further comprising:

adjusting the flow rates of the at least two openings by adjusting the adjustable slit of the flow regulator of each one the at least two openings when it is determined that the differential flow rate between the flow rates of the at least two openings is not within the acceptable range.

6. The method of claim 5, wherein the flow rates of the at least two openings are adjusted by modifying a slit width of the adjustable slit by the flow regulator.

7. The method of claim 5, wherein the flow rates of the at least two openings is adjusted by modifying an iris diaphragm of the adjustable slit by the flow regulator.

8. The method of claim 5, wherein the cell chamber has a cylindrical shape, and wherein the two or more openings are symmetrically arranged at a cross-section of a plane perpendicular to a center axis of the cell chamber and the sidewall of the cell chamber.

9. A method of electrochemical plating on a wafer, comprising:

providing a plating solution from an entry port at a bottom of a cell chamber, wherein a plurality of openings pass through a sidewall of the cell chamber and a flow regulator is arranged with each opening of the plurality of openings;

measuring flow rates of the plating solution flowing through the flow regulator of each opening of the plurality of openings;

calculating, by a feedback controller, a differential flow rate of the plating solution;

determining whether the differential flow rate of the plating solution is within an acceptable range;

in response to determination that the differential flow rate is not within the acceptable range, automatically adjusting a configurable parameter of at least one flow regulator to regulate the differential flow rate within the acceptable range;

sampling a portion of the plating solution; and determining oxidant concentration of the sampled plating solution.

10. The method of claim 9, wherein automatically adjusting the configurable parameter of the at least one flow regulator further comprises:

adjusting an adjustable slit of the at least one flow regulator.

11. The method of claim 10, further comprising, before measuring the flow rates of the plating solution flowing through the flow regulator of each opening of the plurality of openings:

rotating the wafer to cause a rotating movement of the plating solution.

12. The method of claim 10, wherein the differential flow rate comprises one or more differences between flow rates of the plating solution flowing through flow regulators of one or more pairs of the plurality of openings, the method further comprises generating, by the feedback controller, a notification based on a determination indicating the differential flow rate is within the acceptable range.

13. The method of claim 9, wherein the flow regulator of each one of the plurality of openings includes an adjustable slit through which the plating solution passes, the method further comprising:

adjusting flow rate of the plating solution flowing through the flow regulator of each one of the plurality of openings by adjusting the adjustable slit of the flow regulator of each one the plurality of openings.

14. The method of claim 13, wherein the adjustable slit of the flow regulator of each one of the plurality of openings comprises either an adjustable width or an adjustable iris diaphragm, and wherein the flow rate of the plating solution flowing through the flow regulator of each one of the plurality of openings is adjusted by modifying either the adjustable width of the adjustable slit by the flow regulator, or by modifying the adjustable iris diaphragm of the adjustable slit by the flow regulator.

15. A method of electrochemical plating on a wafer, the method comprising:

providing a plating solution through an entry port of a cell chamber into the cell chamber;

directing the plating solution, entered from the entry port, towards a surface of the wafer;

flowing the plating solution through first and second openings in a sidewall of the cell chamber out of the cell chamber;

regulating flow of the plating solution through the first and second openings based on determining whether a differential flow rate between flow rates of the plating solution through the first and second openings is within an acceptable range;

sampling a portion of the plating solution; and determining pH of the sampled plating solution.

16. The method of claim 15, wherein the cell chamber has a cylindrical shape, wherein the first and second openings are arranged at a cross-section of a plane perpendicular to a center axis of the cell chamber and the sidewall of the cell chamber, wherein the first and second openings are diagonally opposed in the plane perpendicular to the center axis.

17. The method of claim 15, wherein a flow regulator is arranged with each of the first and second openings, and wherein the flow regulator adjusts the flow rates of the plating solution through the first and second openings.

18. The method of claim 17, wherein the flow regulator of each one of the first and second openings includes an adjustable slit through which the plating solution passes, the method further comprising:

adjusting the flow rates of the first and second openings by adjusting the adjustable slit of the flow regulator of each one the first and second openings.

19. The method of claim 18, wherein the flow rates of the first and second openings is adjusted by modifying either a slit width of the adjustable slit by the flow regulator, or by modifying an iris diaphragm of the adjustable slit by the flow regulator.

20. The method of claim 17, wherein a controller is coupled to the flow regulator of each one of the first and second openings, and wherein the controller determines the differential flow rate between the flow rates of the plating solution through the first and second openings.

* * * * *